US006714758B2

(12) United States Patent
Miyamoto et al.

(10) Patent No.: US 6,714,758 B2
(45) Date of Patent: Mar. 30, 2004

(54) PRINTING SYSTEM THAT POSITIONS WEB AT ACCURATE WAITING POSITION

(75) Inventors: Atsushi Miyamoto, Hitachinaka (JP); Souichi Nakazawa, Hitachinaka (JP); Masahiro Mizuno, Hitachinaka (JP)

(73) Assignee: Hitachi Printing Solutions, Ltd., Kanagawa-ken (JP)

( * ) Notice: Subject to any disclaimer, the term of this patent is extended or adjusted under 35 U.S.C. 154(b) by 0 days.

(21) Appl. No.: 10/384,730

(22) Filed: Mar. 11, 2003

(65) Prior Publication Data

US 2003/0185608 A1 Oct. 2, 2003

(30) Foreign Application Priority Data

Mar. 29, 2002 (JP) ..... P2002-097263

(51) Int. Cl.[7] ..... G03G 15/00
(52) U.S. Cl. ..... 399/384; 358/1.12; 399/394
(58) Field of Search ..... 399/384, 394, 399/396, 306; 358/1.12

(56) References Cited

U.S. PATENT DOCUMENTS 4,774,524 A * 9/1988 Warbus et al. ..... 346/44
5,548,390 A * 8/1996 Sugisaki et al. ..... 399/384
2002/0081132 A1 * 6/2002 Miyamoto et al. ..... 399/384
2003/0039496 A1 * 2/2003 Miyamoto et al. ..... 399/384
2003/0133731 A1 * 7/2003 Nakazawa et al. ..... 399/384
2003/0165349 A1 * 9/2003 Nakazawa ..... 399/384

* cited by examiner

*Primary Examiner*—Joan Pendegrass
(74) *Attorney, Agent, or Firm*—McGuireWoods LLP

(57) ABSTRACT

A second print device prints images on a rear surface of a web with no sprockets after a first print device prints images on a front surface of the web. A CPF-OFF signal is generated at a time of when an irradiating unit of the second print device completes irradiating for a last page. The second print device calculates, based on a web transport speed at the generation timing of the CPF-OFF signal, a time duration required for the web to reach a predetermined waiting position after the CPF-OFF signal was generated, and starts counting a clock when the time duration elapses from when the CPF-OFF signal was generated. After a last-page image is completely transferred from a photosensitive drum onto the web, the web is transported in a reverse direction by a distance corresponding to the count value, thereby positioning the web at a predetermined waiting position.

5 Claims, 5 Drawing Sheets

PRIOR ART

PRINTING SYSTEM THAT POSITIONS WEB AT ACCURATE WAITING POSITION

BACKGROUND OF THE INVENTION

1. Field of the Invention

The present invention relates to a printing system that prints images on both surfaces of a web.

2. Related Art

There has been proposed a printing system that prints images on both surfaces of a web, which is in a continuous belt shape. The printing system includes a pair of print devices arranged in a row, wherein a web is formed with an image on its front surface by a first print device, discharged from the first print device, turned upside down by a reversing device, fed into a second print device, and then formed with an image on its rear surface.

FIG. 1 shows components of an electrophotographic print device that can be used in such a printing system. In this device, a photosensitive drum 101 is formed with an electrostatic latent image on its surface at a position EP. Then, toner is selectively supplied onto the surface of the photosensitive drum 101, so that a visible toner image corresponding to the electrostatic latent image is formed on photosensitive drum 101. When the toner image comes into contact with a web W at a transfer point TP, the toner image is transferred onto the web W. Afterwards, the toner image is thermally fused onto the web.

This thermal fusion shrinks the web, so that the web has a length shorter than its original length. Accordingly, when an electrophotographic print device is used as the first print device, then there is a danger of positional deviation between the front surface image and the rear surface image on the web W.

However, when n-number of sprockets are formed in each page of the web, then it is possible to avoid such a positional deviation by transporting the web while counting the number of the sprockets in the second print device. That is, transporting the web by n-sprocket-worth of distance means transporting the web by a single-page worth of distance regardless of whether or not the web has shrunk. Because a location of the sprocket in each page head of the web never changes, it is possible to transfer a single-page worth of toner image from the photosensitive drum 101 onto a corresponding page of the web by transporting the web by a distance equivalent to n-number of sprockets. Subsequent pages can also be formed with corresponding single-page worth of images in the same manner.

In other words, if each page head of the web W meets a corresponding page-head position of the photosensitive drum 101 at the transfer point TP, the rear surface image is formed in a positional alignment with a corresponding front surface image, and there is no danger that positional deviation accumulates to greatly deviate the positional relationship between downstream-side front and rear surface images.

Here, when a printing process is started, a web transport speed is accelerated to a predetermined speed. Since it is necessary to reach the predetermined speed before the page head of the first page of the web reaches the transfer point TP, the web is positioned, after a previous printing operation has completed, such that the page head of a first page for a subsequent printing operation locates at a predetermined waiting position WP. The waiting position WP is downstream from the transfer point TP with respect to the web transport direction by a distance $\alpha$, which is required to reach the predetermined speed.

However, when the last-page images are completely transferred onto the web W at the transfer point TP, the page head of the first page for the subsequent printing process has already passed the waiting position WP. Therefore, after the printing has completed, the web W is transported back to the waiting position in the following manner.

When an electrostatic latent image for the last page is completely formed on the photosensitive drum 101, a CPF-OFF signal is generated. When a predetermined time T1 elapses after the CPF-OFF signal was generated, then a PF position clear signal is generated. Here, the time duration T1 is a time between when the CPF-OFF signal is generated and when the page head of the subsequent first page reaches the waiting position WP, and is expressed by the formula:

$$T=(L1-\alpha)/VP \quad (1)$$

wherein L1 is a moving distance of the photosensitive drum 101 from the position EP to the transfer point TP;

$\alpha$ is a distance from the waiting position WP to the transfer point TP; and VP is a process speed of the second print device, which equals to the rotational speed of the photosensitive drum 101.

Upon reception of the PF position clear signal, a measuring unit starts measuring a web transport distance. After the toner image for the last page is completely transferred onto the web W, the web transport is stopped. Then, the web W is transported in a reverse direction by the amount of the web transport distance measured by the measuring unit. In this manner, the web is transported back to the waiting position WP.

There is also provided a printing system of a type that uses a web formed with no sprockets. In this type of printing system, positioning marks are used instead of the sprockets for achieving the positional alignment between the front-surface images and the rear-surface images. More specifically, the first print device prints positioning marks on a predetermined position in each page in addition to the images. A detection unit of the second print device detects the positioning marks and outputs output signals accordingly. Then, the second print device controls the web transport speed such that the output timings of the output signals have the constant phase with respect to CPF-N signals which are generated periodically. The control of the web transport speed is necessary since the web W has a different length between when the front surface printing and when the rear surface printing as mentioned above.

SUMMARY OF THE INVENTION

As described above, when the web with no sprockets is used, the web transport speed is controlled to change during the printing in the above described manner. Therefore, if the PT position clear signal is output when the predetermined time T1 elapses after the CPF-OFF signal was generated, then the web W may not be positioned at the waiting position WP.

Such a problem does not occur in the conventional printing system of a type that uses a web W with sprockets, since the web transport speed can be maintained constant in this case.

In the view of foregoing, it is an object of the present invention to overcome the above problems, and also to provide a method for accurately positioning a web with no sprockets at a predetermined waiting position in a print device.

In order to achieve the above and other objects, according to the present invention, there is provided a printing system including a first printing means for printing images on a first surface of a web, a second printing means for printing images on a second surface of the web, and a control means for controlling both the first and second printing means. The second printing means includes a photosensitive member, an irradiating unit, a developing means, a calculating means, a transport means, and a measuring means. The irradiating unit irradiates a laser light onto the photosensitive member for forming latent images thereon. The control means generates a reference signal when the irradiating unit completes irradiating a laser light for a last page image. The developing means develops the latent images into toner images. The calculating means calculates a time duration required for the web to reach a predetermined waiting position after the reference signal was generated. The transport means stops transporting the web in a forward direction after a last-page toner image is completely transferred from the photosensitive member onto the web. The measuring means measures a web transport distance between when the time duration elapses from when the reference signal was generated and when the transport means stops transporting the web in the forward direction. The transport means transports the web in a reverse direction by the web transport distance measured by the measuring means so as to transport the web back to the web waiting position. The calculating means calculates the time duration based on a web transport speed at the time of when the reference signal was generated.

There is also provided a control method for controlling a second printing means of a printing system that includes a first printing means for printing images on a first surface of a web and the second printing means for printing images on a second surface of the web, the second printing means including a photosensitive member, an irradiating unit that irradiates a laser light onto the photosensitive member, and a web transport means for transporting the web. The control method includes the steps of a) generating a reference signal at a time of when the irradiating unit completes irradiating a laser light for a last page image, b) calculating a time duration required for the web to reach a predetermined waiting position after the reference signal was generated, c) controlling the web transport means to stop transporting the web in a forward direction after a last-page image is completely transferred from the photosensitive member onto the web, d) measuring a web transport distance by which the web has been transported between when the time duration has elapsed from when the reference signal was generated and when the web transport was stopped in the step c), and e) controlling the web transport means to transport the web back to the waiting position, by transporting the web in a reverse direction by the web transport distance measured in the step d). The time duration is calculated in the step b) based on a web transport speed at the time of when the reference signal was generated.

PREFERRED EMBODIMENT OF THE PRESENT INVENTION

Next, a control method according to an embodiment of the present invention will be described with reference to the attached drawings.

Figure 1:
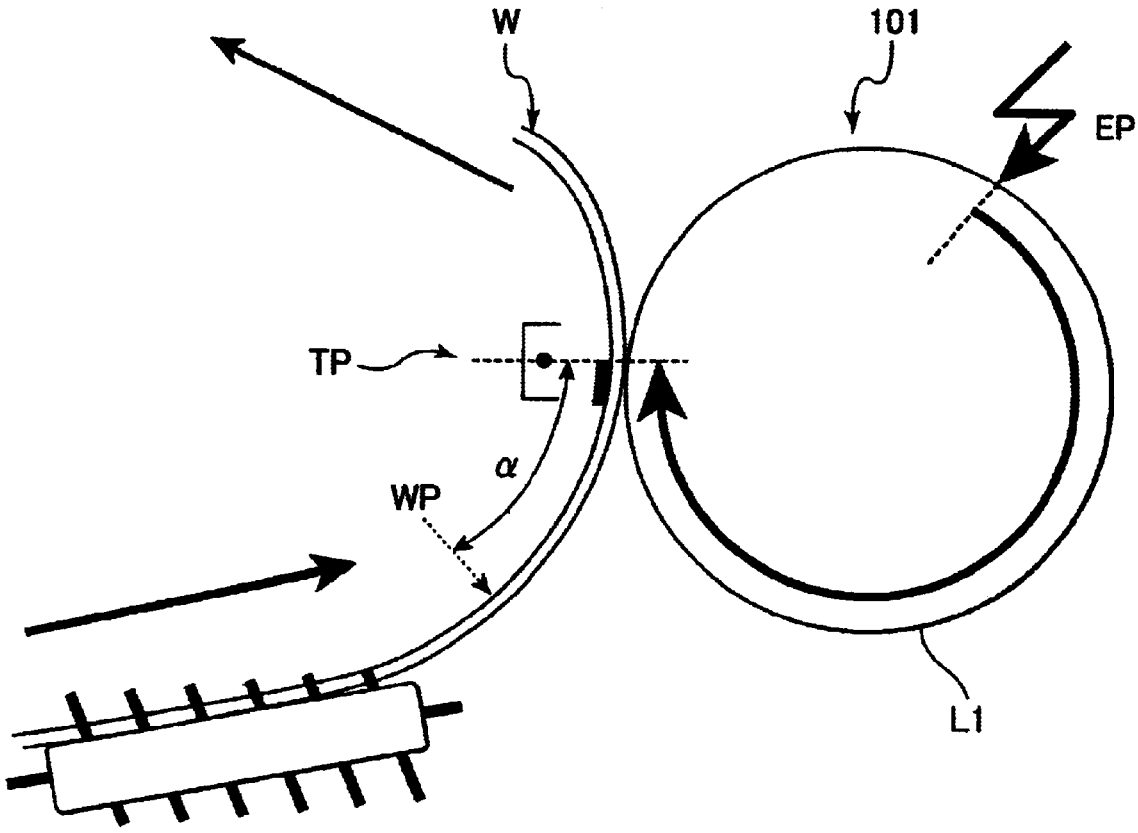
FIG. 1 is an explanatory plan view of components of a conventional print device.
Figure 2:
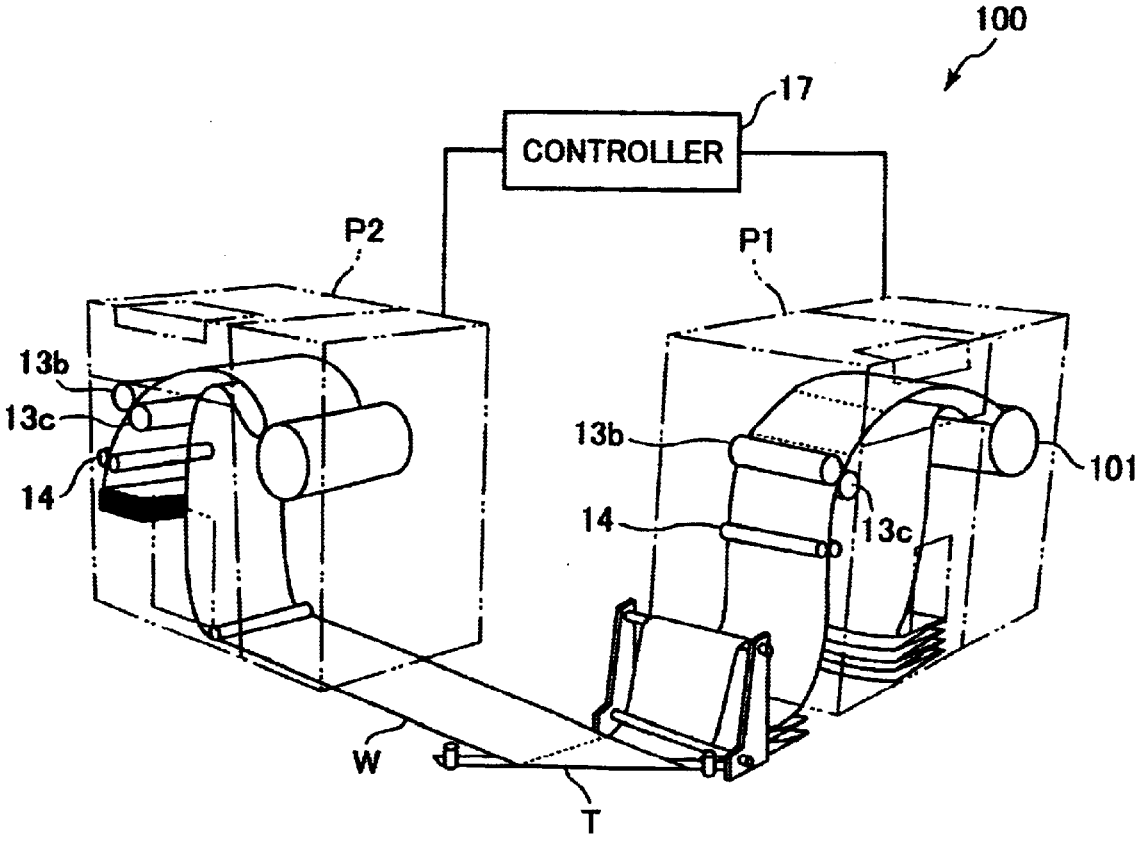
FIG. 2 is a perspective phantom view of a printing system according to an embodiment of the present invention.

As shown in FIG. 2, a printing system 100 according to the present embodiment includes a pair of print devices P1 and P2, an inversion device T disposed between the print devices P1 and P2, and a controller 17 for controlling both the print devices P1 and P2. First, configuration of the print device P1 will be described. Here, since the print devices P1 and P2 have basically the same configuration, only explanation for the print device P1 will be provided. Also, since the inversion device T is well known in the art, explanation thereof will be omitted.

Figure 3:
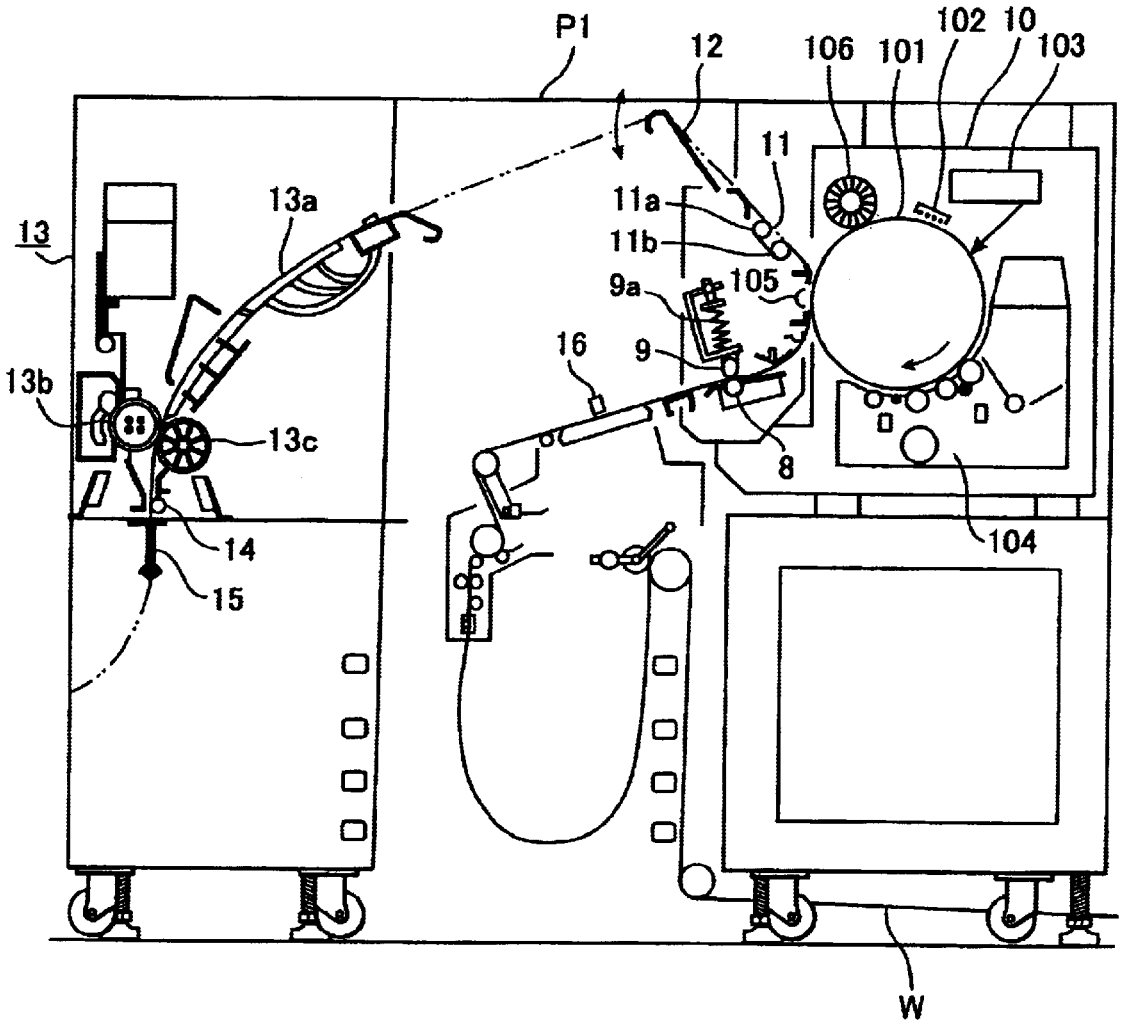
FIG. 3 is a plan view showing an internal configuration of a print device of the printing system.

As shown in FIG. 3, the print device P1 includes a pair of transport rollers 8, 9, a printing unit 10, a transport belt 11, a buffer plate 12, a fixing unit 13, a discharge roller 14, a swing fin 15, and a mark sensor 16. The transport roller 8 is a drive roller having its own driving source, and the transport roller 9 is a driven roller that is urged onto the transport roller 8 via a web W by an urging force of a spring 9*a*. The transport belt 11 is wound around and extending between a driving roller 11*a* and a driven roller 11*b*.

Rotation of the transport rollers 8, 9 transports the web W to the printing unit 10, which is an electrophotographic print unit in this embodiment. The printing unit 10 includes a photosensitive drum 101, a corona charging unit 102, a light source 103, a developing unit 104, and a transfer unit 105. When the photosensitive drum 101 starts rotating, the corona charging unit 102 is applied with a high voltage so as to uniformly charge the surface of the photosensitive drum 101. The light source 103, which is formed of a semiconductor laser or a light-emitting diode, irradiates a light beam on the photosensitive drum 101, whereby an electrostatic latent image is formed on the photosensitive drum 101.

When the electrostatic latent image comes into confrontation with the developing unit 104, the electrostatic latent image is developed into a visible toner image on the photosensitive drum 101. Thus formed toner image is transferred onto a front surface of the web W by the transfer unit 105 having an opposite polarity from that of the toner image. The web W with the toner image transferred thereon is supplied onto the transport belt 11, and further transported along the buffer plate 12. Although not shown in the drawings, there is provided a suction member that enables the transport belt 11 to transport the web W with its rear surface attached to the transport belt 11 by generating suctioning force. Then, the web W reaches the fixing unit 13.

The fixing unit 13 includes a pre-heater 13*a*, a heat roller 13*b*, and a pressure roller 13*c* that presses against the heat roller 13*b*, thereby defining a nip portion therebetween. The web W having reached the fixing unit 13 is preheated by the pre-heater 13*a*, and then further transported through the nip portion between the pre-heater 13*a* and the heat roller 13*b*. At this time, the toner image is thermally fused onto the web W.

The web W discharged from the fixing unit 13 is further transported to the discharge roller 14., and usually the web W is folded back and forth into an accordion fold by the swing movement of the swing fin 15 and stored in the print device P1. However, because the print device P2 is disposed behind the print device P1 in this printing system 100, the web W discharged from the fixing unit 13 is discharged outside the print device P1 via the discharge roller 14. Thus discharged web W is inverted upside down by the inversion device T and then supplied into the print device P2 where images are formed on a rear surface of the web W.

The mark sensor 16 is for detecting positioning marks (described later) formed in the web W and outputting mark detection signals.

Next, printing operation of the printing system 100 will be described.

Figure 4:
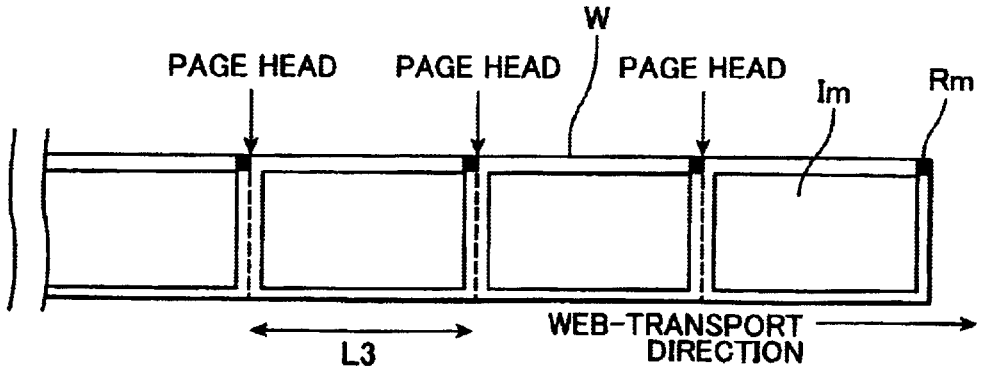
FIG. 4 is a plan view of a web printed with positioning marks.

First, as shown in FIG. 4, the first print device P1 forms on the front surface of the web W an image Im based on print data and in addition the positioning mark (toner marks) Rm at the page head of each page. The same unit can be used to form both the positioning mark Rm and the image Im, or a separate unit can be provided for forming the positioning mark Rm. In the present embodiment, the same unit is used to form both the positioning mark Rm and the image Im, and the positioning mark Rm is formed at the same time as the image Im.

The web W discharged from the first print device P1 is inverted upside down by the inverting unit T, and then supplied into the second print device P2. By inverting the web W upside down by the inverting unit T, the front surface of the web W formed with the images Im and the positioning marks Rm comes into confrontation with a detection surface of the mark sensor 16 in the print device P2, and the rear surface of the web W, which is still unprinted at this time, comes into confrontation with the surface of the photosensitive drum 101.

Figure 5:
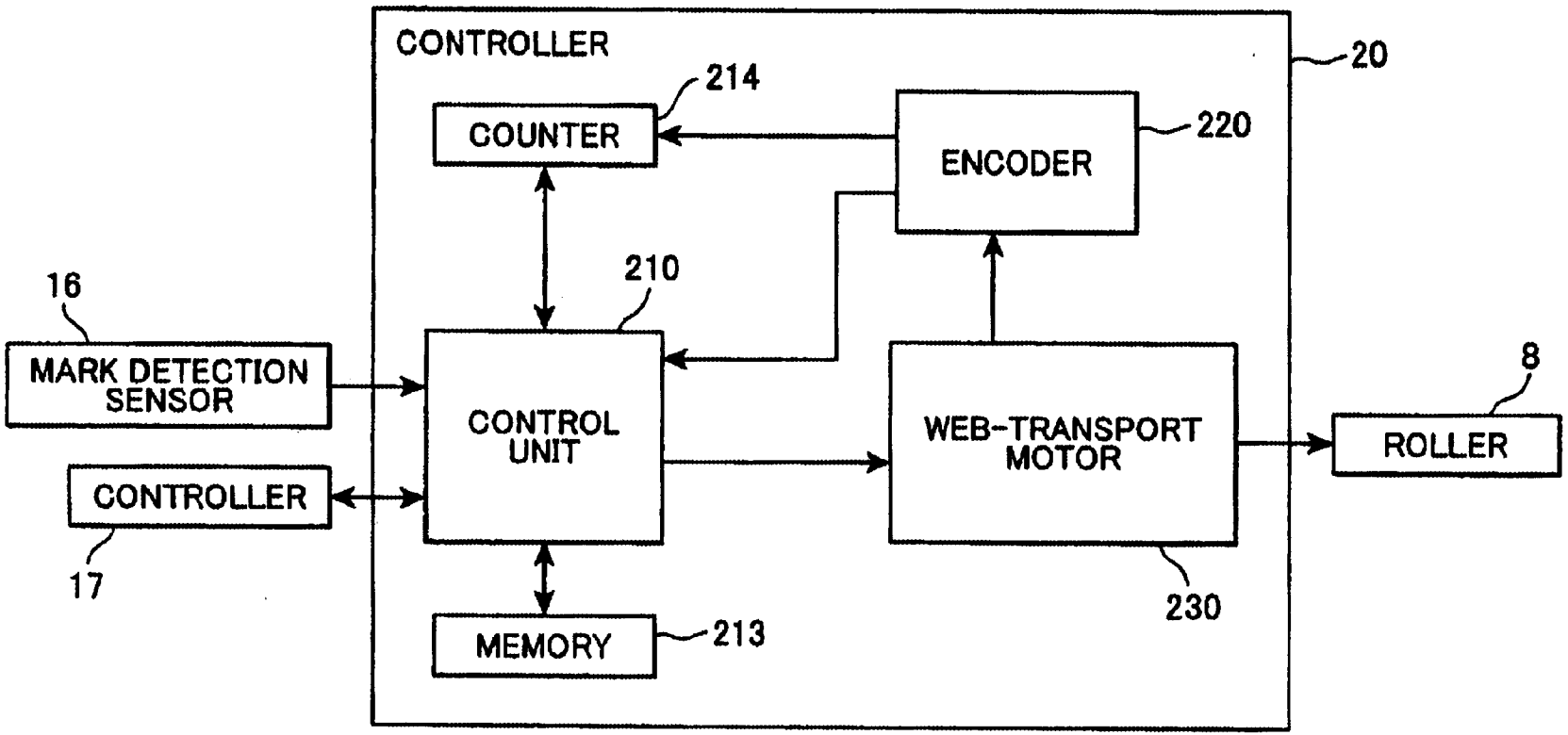
FIG. 5 is an explanatory view of web transport control of the embodiment of the present invention.

In addition to the above configuration, the second print device P2 further includes a controller 20 shown in FIG. 5 including a control unit 210, a-memory 213, a counter 214, an encoder 220, and a web-transport motor 230. Various signals from the controller 17 and a mark detection signal from the mark sensor 16 are input to the control unit 210. Details will be described later.

Each time the light source 103 of the second print device P2 starts irradiating a laser light for a page, and the controller 17 generates a web-transport control signal (hereinafter referred to as "CPF-N signal"), which is input to the control unit 210.

Next, basic principles behind the control for matching positions of images on the front and rear surfaces of the web W will be described.

Figure 6:
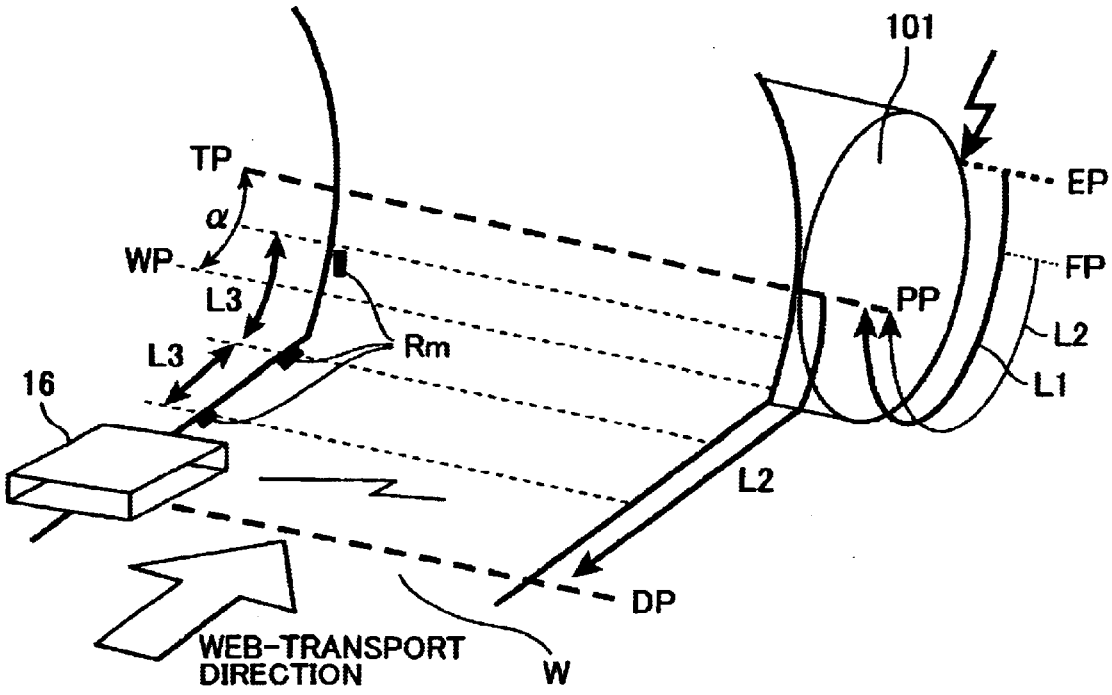
FIG. 6 is a block diagram of a controller of a second print device of the printing system.

FIG. 6 is a schematic view for explaining positioning control operations. During printing operations, the photosensitive drum 101 rotates at a predetermined process speed VP, and toner images formed on the photosensitive drum 101 are transferred onto the surface of the web W at a transfer point TP shown in FIG. 6 where the photosensitive drum 101 contacts the web W. The control unit 210 controls a web-transport speed through the web-transport motor 230 such that a positioning mark Rm on the web W and a corresponding position PP that is imaginary defined on the surface of the photosensitive drum 101 meet at the transfer point TP in order to achieve the positional alignment between the front-surface images and the rear-surface images.

In other words, the position PP indicates a position of a page head on the photosensitive drum 101. As mentioned above, in the print device P2, each time the light source 103 starts irradiation for a page, the controller 17 produces the CPF-N signal. Because the photosensitive drum 101 rotates at the fixed process speed VP, the position PP reaches the transfer point TP at the cycle of the CPF-N signal, that is, each time the web W is transported by the length of CPF-N signal. Accordingly, by controlling the web-transport speed such that the difference between the generation timing of the CPF-N signal and the detection timing of the positioning mark Rm is fixed, the position PP on the photosensitive drum 101 and the corresponding positioning mark Rm at the page head of the web W can meet at the transfer point TP.

As shown in FIG. 6, there is a moving distance L1 of the photosensitive drum 101 from a position EP to the transfer point TP. The position EP is where the laser beam from the light source 103 is irradiated on the photosensitive drum 101. Also, there is a moving distance L2 of the web W from a detection point DP where the mark sensor 16 detects the positioning mark Rm to the transfer point TP.

In order to make the position PP and the corresponding positioning mark Rm to reach the transfer point TP at the same time, the position PP should be located upstream from the transfer point TP by the distance L2 at the time of when the mark sensor 16 detects the corresponding positioning mark Rm at the detection point DP that is upstream from the transfer point TP by the distance L2.

In the present embodiment, "control timing" will be referred to a theoretical detection timing of the positioning mark Rm when the web W is being transported in an appropriate web-transport speed wherein the positioning mark Rm will meet a corresponding position PP at the transfer point TP. With this definition, appropriate positioning of a rear-surface image is achieved by controlling the web transport speed such that the actual detection timing constantly matches the control timing.

Next, the positioning control of the present embodiment will be described.

As described above, a CPF-N signal is generated each time the light source 103 of the second print device P2 starts irradiating a laser light for a page. Accordingly, a first CPF-N signal is generated when the light source 103 starts irradiating a laser light for a first page. Then, a second CPF-N signal is generated when the light source 103 starts irradiating a laser light for a second page. Here, in order for a position PP indicating a page head position of the second page on the photosensitive drum 101 to meet the corresponding positioning mark Rm at the transfer point TP, it is necessary that the corresponding positioning mark Rm be detected at the time of when the position PP on the photosensitive drum 101 reaches a position FP which is upstream from the transfer point TP by a distance of L2. Accordingly, the following equation is obtained:

$$T2=(L1-L2)/VP \quad (2)$$

wherein T2 is a time duration between when the second CPF-N signal was generated and the control timing;

L1 is a moving distance of the photosensitive drum from the exposure position EP to the transfer point TP;

L2 is a moving distance of the web W from the mark detection position DP to the transfer point TP; and VP is a rotational speed of the photosensitive drum 101.

Since the CPF-N signal is generated once for each page, the control timing is at the cycle of the CPF-N signal. In other words, the time interval of the successive control timings equals to a length of the CPF-N signal.

Then, a gap between the control timing and the actual mark detection timing is determined. If the mark detection timing is behind the corresponding control timing, then the control unit 210 controls the web-transport motor 230 to accelerate the web transport speed. Contrarily, if the mark detection timing is ahead of the corresponding control timing, then the control unit 210 controls the web-transport motor 230 to decelerate the web transport speed. In this manner, the controller 20 controls the web transport speed such that the mark detection timing matches the corresponding control timing.

Next, print-stop process according to the present embodiment will be described.

At the timing of when the light source 103 completes irradiation for the last page, the controller 20 receives a CPF-OFF signal at the control unit 210 from the controller 17, whereupon the control unit 210 starts the print-stop process.

When the print-stop process starts, first the control unit 210 calculates a time T5 using the following equation:

$$T5=(L1-\alpha)/V1 \quad (3)$$

wherein T5 is a time that is required for a positioning mark Rm on the first page of a subsequent printing operation to reach a waiting position WP (FIG. 6) after the CPF-OFF signal was generated;

L1 is a moving distance of the photosensitive drum 101 from the position EP to the transfer point TP;

$\alpha$ is a moving distance of the web W from the waiting position WP to the transfer point TP; and V1 is a web transport speed at the time of when the CPF-OFF signal was generated.

Here, the web transport speed V1 is detected by monitoring encoder pulses that encoder 220 outputs in synchronization with the driving movement of the web-transport motor 230.

Then, the control unit 210 resets the counter 214 to zero after the time T5 elapses from when the CPF-OFF signal was received. Then, the counter 214 starts counting up the encoder pulse from the encoder 220. After the images for the last page have completely been transferred from the photosensitive drum 101 onto the web W at the transfer point TP, the control unit 210 controls the web-transport motor 230 to stop transporting the web W. At the same time, the control unit 210 reads the counter value of the counter 214. Then, the control unit 210 controls the web-transport motor 230 to transport the web W in a reverse direction by the distance corresponding to the counter value. In this manner, the web W is transported back to the waiting position WP by the distance of $\alpha$.

In this manner, according to the above embodiment of the present invention, it is possible to precisely position the web W with no sprockets at the predetermined waiting position WP even if the web transport speed fluctuates, because the time T5 is determined based on the actual web-transport speed V1 rather than the process speed VP.

While some exemplary embodiments of this invention have been described in detail, those skilled in the art will recognize that there are many possible modifications and variations which may be made in these exemplary embodiments while yet retaining many of the novel features and advantages of the invention.

For example, the positioning control is not limited to what described in the above embodiment. For example, the control unit 210 can stores a mark detection time in the memory 213 each time the mark sensor 16 detects the positioning mark Rm. The mark detection time indicates a time interval between when the CPF-N signal is generated and when the corresponding positioning mark Rm is detected. Then, the control unit 210 calculates a time difference $\Delta t$ between the mark detection time T4 which has been stored into the memory 213 this time and a mark detection time T3 which has been stored into the memory 213 last time, using the following equation:

$$\Delta t=T4-T3 \quad (4)$$

Then, the control unit 210 controls the web-transport motor 230 to change the web-transport speed by an amount of $\Delta v$, which can be calculated using the equation:

$$\Delta v=(\Delta t/CPF\ \text{length})\times v \quad (5)$$

wherein $\Delta t$ is a time difference between a mark detection time T4 of this time and a mark detection time T3 of last time;

CPF length is a length of the CPF-N signal; and v is a current web-transport speed.

By changing the current web-transport speed by the amount of $\Delta v$, the mark detection timing will match the corresponding control timing.

What is claimed is:

1. A printing system comprising:

a first printing means for printing images on a first surface of a web;

a second printing means for printing images on a second surface of the web; and a control means for controlling both the first and second printing means, the control means generating a reference signal, wherein the second printing means includes:

a photosensitive member;

an irradiating unit that irradiates a laser light onto the photosensitive member for forming latent images thereon, wherein the control means generates the reference signal when the irradiating unit completes irradiating a laser light for a last page image;

a developing means for developing the latent images into toner images;

a calculating means for calculating a time duration required for the web to reach a predetermined waiting position after the reference signal was generated;

a transport means for transporting the web both in a forward direction and a reverse direction, wherein the transport means stops transporting the web in the forward direction after a last-page toner image is completely transferred from the photosensitive member onto the web; and a measuring means for measuring a web transport distance between when the time duration elapses from when the reference signal was generated and when the transport means stops transporting the web in the forward direction, wherein the transport means transports the web in the reverse direction by the web transport distance measured by the measuring means so as to transport the web back to the web waiting position; and the calculating means calculates the time duration based on a web transport speed at the time of when the reference signal was generated.

2. The printing system according to claim 1, wherein the first print device forms a positioning mark at a predetermined position on the first surface of the web, and the second print device further includes a detection means for detecting the positioning mark.

3. The printing system according to claim 1, wherein the predetermined position is a predetermined distance upstream from a transfer position, at which the toner images are transferred from the photosensitive member onto the web, with respect to the forward direction, and the transport means takes the predetermined distance to accelerates the web to a predetermined speed.

4. The printing system according to claim 1, wherein the measuring means includes a counter that starts counting a clock when the time duration elapses from when the reference signal was generated, and a reading means for reading a count value of the counter at the time of when the transport means has stopped transporting the web in the forward direction.

5. A control method for controlling a second printing means of a printing system that includes a first printing means for printing images on a first surface of a web and the second printing means for printing images on a second surface of the web, the second printing means including a photosensitive member, an irradiating unit that irradiates a laser light onto the photosensitive member, and a web transport means for transporting the web, the control method comprising the steps of:

a) generating a reference signal at a time of when the irradiating unit completes irradiating a laser light for a last page image;

b) calculating a time duration required for the web to reach a predetermined waiting position after the reference signal was generated;

c) controlling the web transport means to stop transporting the web in a forward direction after a last-page image is completely transferred from the photosensitive member onto the web;

d) measuring a web transport distance by which the web has been transported between when the time duration has elapsed from when the reference signal was generated and when the web transport was stopped in the step c); and e) controlling the web transport means to transport the web back to the waiting position, by transporting the web in a reverse direction by the web transport distance measured in the step d), wherein the time duration is calculated in the step b) based on a web transport speed at the time of when the reference signal was generated.

* * * * *